United States Patent [19]

Young et al.

[11] 4,403,579

[45] Sep. 13, 1983

[54] INTERNAL COMBUSTION ENGINE IGNITION DISTRIBUTOR DRIVE ARRANGEMENT

[75] Inventors: Robert E. Young; Bobbie D. Bridgewater, both of Anderson, Ind.

[73] Assignee: General Motors Corporation, Detroit, Mich.

[21] Appl. No.: 295,557

[22] Filed: Aug. 24, 1981

[51] Int. Cl.[3] ..... F02P 7/00

[52] U.S. Cl. ..... 123/146.5 A

[58] Field of Search ..... 123/146.5 A; 200/19 DC, 200/19 R, 19 DR, 306, 19 A, 21, 24, 27 R, 27 A; 277/180; 287/126

[56] References Cited

U.S. PATENT DOCUMENTS

| | | | |
|---|---|---|---|
| 2,404,017 | 7/1946 | Wilkenson | 123/146.5 A |
| 2,472,327 | 6/1949 | Zoerlein | 123/146.5 A |
| 2,688,055 | 8/1954 | Schneider et al. | 123/146.5 A |
| 3,429,581 | 2/1969 | Himmel | 277/180 |
| 3,485,520 | 12/1969 | Alexander | 287/126 |
| 3,542,976 | 11/1970 | Moray | 123/146.5 A |
| 3,662,726 | 5/1972 | Haskew et al. | 123/146.5 A |

*Primary Examiner*—Raymond A. Nelli
*Attorney, Agent, or Firm*—C. R. Meland

[57] ABSTRACT

A projection having contoured sides that is carried by a member drivably engaging an internal combustion engine ignition distributor shaft is forced, upon assembly of the distributor to the engine, into an accommodating notch on the end of the engine camshaft adjacent the distributor shaft. The notch in the camshaft has substantially plane sidewalls that taper substantially equally inwardly at such an angle that each may tangentially engage a respective contoured side of the projection.

3 Claims, 4 Drawing Figures

INTERNAL COMBUSTION ENGINE IGNITION DISTRIBUTOR DRIVE ARRANGEMENT

This invention is directed to an internal combustion engine ignition distributor drive arrangement and, more specifically, to such a drive arrangement wherein, upon assembly of the distributor to the engine, a projection having substantially equally contoured sides that is carried by a member drivably engaging the distributor shaft is forced into an accommodating notch that is located in the end of the engine camshaft adjacent the distributor shaft and has substantially plane sidewalls that taper substantially equally inwardly at such an angle that each may tangentially engage a respective contoured side of the projection.

To reduce ignition spark scatter in internal combustion engines, it is important that the ignition distributor drive arrngement be such that mating coupling backlash and any lost motion between the mating parts be substantially eliminated.

It is therefore an object of this invention to provide an improved internal combustion engine ignition distributor drive arrangement.

It is another object of this invention to provide an improved internal combustion engine ignition distributor drive arrangement that substantially eliminates distributor drive backlash and lost motion between the mating parts.

It is another object of this invention to provide an improved internal combustion engine ignition distributor drive arrangement in which a tooth or projection having substantially equally contoured sides that is carried by a member drivably engaging the distributor shaft is spring biased into an accommodating notch that is located in the end of the engine camshaft adjacent the distributor shaft and has substantially plane sidewalls that taper substantially equally inwardly at such an angle that each may tangentially engage a respective contoured side of the projection.

In accordance with this invention, an internal combustion engine ignition distributor drive arrangement is provided wherein, upon assembly of the distributor to the engine, a projection having substantially equally contoured sides that is carried by a member drivably engaging the distributor shaft is spring biased into an accommodating notch that is located in the end of the engine camshaft adjacent the distributor shaft and has substantially plane sidewalls that taper substantially equally inwardly at such an angle that each may tangentially engage a respective contoured side of the projection.

For a better understanding of the present invention, together with additional object, advantages and features thereof, reference is made to the following description and accompanying drawing in which.

Broadly, this invention is an internal combustion engine ignition distributor drive arrangement through which the distributor shaft is driven by and in an end-to-end relationship with the engine camshaft when the distributor is assembled on the engine.

Figure 1:
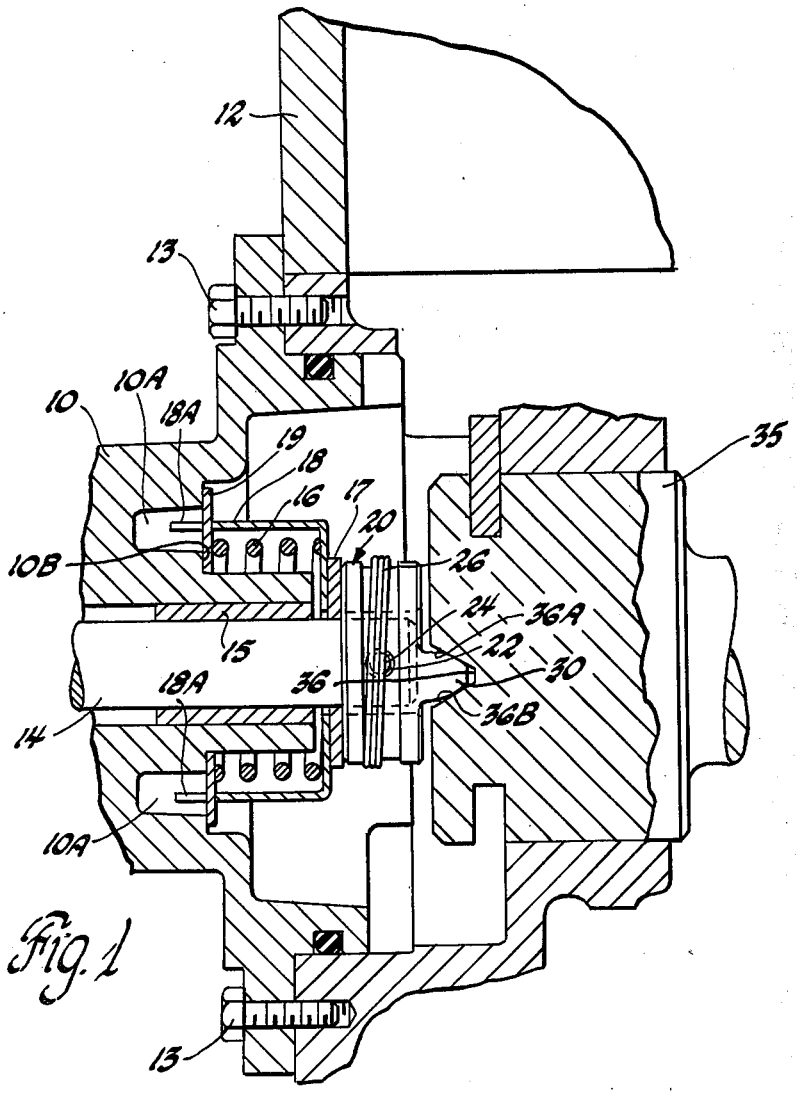
FIG. 1 is an elevation view partially in section of the ignition distributor drive arrangement of this invention.

FIG. 1 illustrates the drive end of a horizontally mounted ignition distributor having a distributor base 10 secured to the block 12 of an internal combustion engine by bolts 13 threaded to the block 12. The distributor shaft 14 is rotatably supported in the base 10 by one or more sleeve bearings one of which is designated by reference numeral 15. The shaft 14 drives a distributor rotor cooperating with the terminals of a distributor cap that is supported by the other end of the base. The shaft 14 further drives a rotor of a conventional magnetic pickup or in the case of a distributor that uses breaker contacts could drive a breaker cam. The just mentioned parts have not been illustrated since they are well known to those skilled in the art.

The distributor base 10 carries a spring and washer assembly including a coil compression spring 16, a washer 17 and a retainer member 18 having an opening through which the distributor shaft 14 extends. The retainer 18 is cup-shaped and has three circumferentially spaced extensions or arms, two of which are illustrated and identified by reference numeral 18A. These arms extend through corresponding openings in a washer 19 and are positioned in pockets 10A of the base 10 to prevent rotation of the parts 18 and 19. The washer 19 abuts an annular wall 10B of the base 10. The spring 16 is compressed between parts 18 and 19 and urges the part 18 to the right in FIG. 1 relative to part 19. The end of part 18 engages the washer 17 to spring bias it to the right as viewed in FIG. 1. An annular coupling member 20 is disposed about and arranged to drive the distributor shaft 14, being loosely keyed thereto by a pin 22 that extends through a radially extending opening in distributor shaft 14 and a pair of aligned openings or holes, one of which is shown in FIG. 1 and referenced by the numeral 24, on opposite sides of coupling member 20. A retainer spring 26 surrounding coupling member 20 retains pin 22 in place. The openings 24 are circular but are larger in diameter than the pin 22 by an amount that will permit limited axial movement of coupling member 20 along distributor shaft 14. Therefore, while the distributor is not assembled to the engine, coil compression spring 16 forces washer 17 and coupling member 20 in a direction to the right as viewing FIG. 1 to a position determined by the amount of movement permitted by over-sized openings 24.

Figure 2:
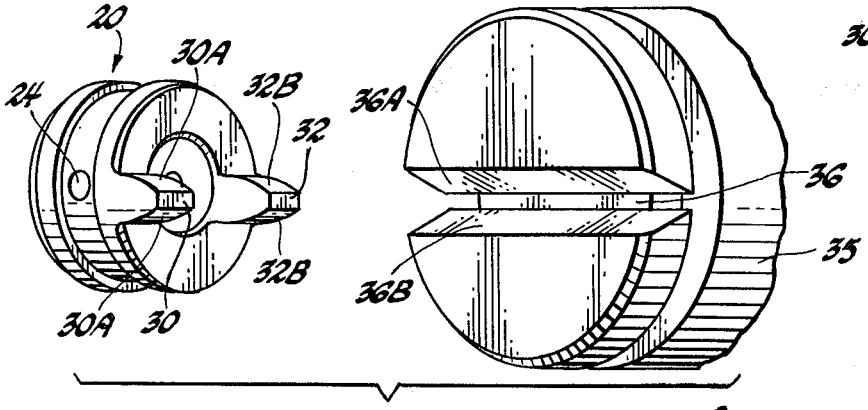
FIG. 2 is a perspective view of the coupling arrangement of this invention.

Coupling member 20 drives distributor shaft 14 through the pin 22 and openings 24 and has teeth or projections 30 and 32, FIG. 2, that extend axially in the direction of distributor shaft 14. The teeth have opposing face surfaces 30A and 32B that are substantially equally contoured toward each other from the root to the tip thereof. Although coupling member 20 is illustrated in the drawing as having two teeth it is to be understood that a single tooth could be used that would extend uninterrupted across the end face of coupling member 20.

Provided in the end of engine camshaft 35 adjacent distributor shaft 14 is a notch 36, FIG. 2, having substantially plane sidewalls 36A and 36B that taper substantially equally inwardly at such an angle that each may tangentially engage a respective one of the face surfaces of the teeth 30 and 32. In some instances the camshaft 35 might be provided with a longitudinally extending central oil passage (not illustrated) terminating in an opening facing the right end of coupling device 20. With this arrangement two aligned notches can be used on the end of camshaft 35 that extend radially inwardly to the end of the oil passage and which would accommodate teeth 30 and 32 instead of a single notch.

Upon the assembly of the ignition distributor to the engine, distributor base 10 is clamped tightly against engine block 12 by the bolts 13 or any other suitable clamping device and the walls defining the camshaft notch 36 in the end of engine camshaft 35 adjacent distributor shaft 14 engages the teeth 30 and 32 of coupling member 20. Coil compression spring 16 forces the face surfaces 30A and 32B into tight engagement with the tapered sidewalls 36A and 36B of the camshaft notch 36.

Figure 3:
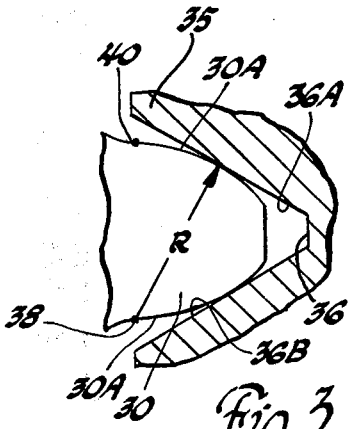
FIG. 3 is an enlarged view of a portion of FIG. 1 illustrating the configuration of a mating tooth and notch of the drive arrangement of this invention.

Referring now more particularly to FIG. 3, which is an enlarged view of one of the teeth 30 positioned in notch 36, it can be seen that the contoured faces 30A are curved. More particularly, the upper face 30A, as viewed in FIG. 3, is an arc of a circle having a center at a point identified by reference numeral 38 with a radius R. The lower face 30A is identical to the upper face having a curved surface formed by an arc of a circle having a center at a point designated by reference numeral 40. The taper of the walls 36A and 36B may be approximately 30° to the longitudinal axis of the camshaft 35. The faces 32B have the same size and shape as faces 30A. It can be seen that the curved face surfaces 30A and 32B tangentially engage the walls 36A and 36B of the notch 36 at a preselected contact point that is dictated by design considerations.

With the arrangement that has been described, as engine camshaft 35 is rotated the rotational motion is transmitted through the camshaft notch and coupling member 20 projection to distributor shaft 14 and because of the intimate engagement of the face surfaces of the projection carried by coupling member 20 and the tapered sidewalls of the engine camshaft notch distributor drive backlash is substantially eliminated. In this regard, it is pointed out that the spring 16 maintains tight tangential engagement between the teeth and the notch so that the shaft 14 is positively driven by the camshaft without lost motion. Since the spring biased coupler 20 can move axially of the shaft 14 to the extent provided by the larger diameter hole 24 the teeth are always positively spring forced against the walls of the notch when the distributor is assembled to the engine. Since tight engagement is maintained between the teeth and notch the drive of this invention tends to reduce audible noise or chatter otherwise associated with mating type couplings.

It can be seen from the drawings that the teeth 30 and 32 and the notch 36 are slightly radially offset from the longitudinal axis of coupler 20 and camshaft 35. This provides an arrangement in which the parts can be assembled together in only a certain relative angular relationship.

While a preferred embodiment of the present invention has been shown and described, it will be obvious to those skilled in the art that various modifications and substitutions may be made without departing from the spirit of the invention that is to be limited only within the scope of the appended claims.

The embodiments of the invention in which an exclusive property or privilege is claimed are defined as follows:

1. An internal combustion engine ignition distributor drive arrangement through which the distributor shaft is driven by and in an end-to-end relationship with the engine camshaft when the distributor is assembled on the engine comprising:

means drivably engaging said distributor shaft having at least one projection that extends in the direction of the longitudinal axis of said shaft and has two opposed face surfaces that extend axially of the shaft and are substantially equally curved toward each other from the root to the tip thereof;

a projection accommodating notch in the end of said camshaft adjacent said distributor shaft having substantially plane sidewalls that taper substantially equally inwardly at such an angle that each may tangentially engage a respective one of said projection face surfaces; and means for forcing said projection face surfaces into intimate engagement with said tapered sidewalls of said notch when said distributor is assembled on said engine whereby distributor drive backlash is substantially eliminated.

2. An internal combustion engine ignition distributor drive arrangement through which the distributor shaft is driven by and in and end-to-end relationship with the engine camshaft when the distributor is assembled on the engine comprising:

means drivably engaging said distributor shaft having a split projection that extends in the direction of the longitudinal axis of said shaft and has two opposed face surfaces that extend axially of the shaft and are substantially equally contoured toward each other from the root to the tip thereof;

a projection accommodating notch in the end of said camshaft adjacent said distributor shaft having substantially plane sidewalls that taper substantially equally inwardly at such an angle that each may tangentially engage a respective one of said projection face surfaces; and means for forcing said projection face surfaces into intimate engagement with said tapered sidewalls of said notch when said distributor is assembled on said engine whereby distributor drive backlash is substantially eliminated.

3. An internal combustion engine ignition distributor drive arrangement through which the distributor shaft is driven by and in end-to-end relationship with the engine camshaft comprising:

a distributor mounted to said engine having a distributor shaft aligned with the end of the camshaft of the engine;

a coupling member, means connecting said coupling member to said distributor shaft such that the coupling member can rotatably drive the distributor shaft and can move axially of the distributor shaft by a limited amount;

at least one tooth on said coupling member extending axially of said coupling member toward the end of said camshaft having two opposed face surfaces that extend axially of the coupling member and are substantially equally curved toward each other from root to tip thereof; and resilient means interposed between the distributor and coupling member urging said coupling member axially toward the end of said camshaft so that said face of said tooth tightly engages the tapered walls of said notch, the curvature of said faces and the taper of said notch walls being such that tangential engagement is provided between the notch walls and the curved faces.

* * * * *